US005598669A

United States Patent [19]

Hamdi et al.

[11] Patent Number: 5,598,669

[45] Date of Patent: Feb. 4, 1997

[54] ACOUSTIC INSULATING BOX

[75] Inventors: Mohamed A. Hamdi, Compiegne; Hamid Bouhioui, Compiegne Cedex; Marc Rehfeld, Ezanville, all of France

[73] Assignee: Saint Gobain Vitrage International "Les Miroirs" , Courbevoie, France

[21] Appl. No.: 91,918

[22] Filed: Jul. 16, 1993

[30] Foreign Application Priority Data

Jul. 16, 1992 [FR] France ..... 92 08772

[51] Int. Cl.[6] ..... E06B 3/00

[52] U.S. Cl. ..... 52/144; 52/786.13; 52/795.1; 181/284

[58] Field of Search ..... 52/144, 788, 790, 52/398, 209, 786.1, 786.13, 787.11, 795.1; 181/284, 286

[56] References Cited

U.S. PATENT DOCUMENTS

| | | | |
|---|---|---|---|
| 621,542 | 3/1899 | Sheppard | 52/398 X |
| 2,597,097 | 5/1952 | Haven . | |
| 3,783,084 | 1/1974 | Quenett | 52/789 X |
| 4,114,342 | 9/1978 | Okawa | 181/284 X |
| 4,658,553 | 4/1987 | Shinagawa | 52/788 X |
| 4,706,422 | 11/1987 | Ashton | 52/144 X |
| 4,994,309 | 2/1991 | Reichert et al. | 52/790 X |
| 5,087,489 | 2/1992 | Lingemann | 52/788 X |
| 5,088,258 | 2/1992 | Schield et al. | 52/398 |
| 5,094,055 | 3/1992 | Berdan | 52/788 X |
| 5,290,611 | 3/1994 | Taylor | 52/790 X |

FOREIGN PATENT DOCUMENTS

| | | |
|---|---|---|
| 0202555 | 11/1986 | European Pat. Off. . |
| 1509275 | 1/1969 | Germany . |
| 1659661 | 1/1971 | Germany . |
| 2350602 | 4/1975 | Germany . |
| 2748223 | 5/1979 | Germany . |
| 3401996 | 7/1984 | Germany . |
| WO85/02640 | 6/1985 | WIPO . |

*Primary Examiner*—Robert Canfield

*Attorney, Agent, or Firm*—Oblon, Spivak, McClelland, Maier & Neustadt, P.C.

[57] ABSTRACT

In order to improve an acoustic insulation performance of a box with parallel faces such as an insulating glazing, the box is equipped with a waveguide. Preferably, the waveguide is situated at the periphery and communicates with the gap of the box via localized orifices situated on each of the sides.

13 Claims, 3 Drawing Sheets

ACOUSTIC INSULATING BOX

BACKGROUND OF THE INVENTION

1. Field of the Invention

The present invention relates to an acoustic insulation of a multi-walled plane box and more particularly of an insulating glazing.

2. Discussion of the Background

Insulating glazings, comprising two or more glass sheets assembled together by way of an insert frame which keeps them a certain distance apart while trapping a gas space between them, in general a dry air space, are used in most cases for improving thermal insulation of buildings or possibly even of land transport vehicles.

The most widespread systems use glasses with a common thickness of 4 mm separated by a gap of between 6 and 12 mm. As such, these glazings have limited acoustic performance, substantially below that of a monolithic glass of the same overall mass per unit area.

In industry, various means are used to improve the acoustic performance of insulating glazings. The most widespread comprise using glasses of great and different thicknesses. This means has limited efficacy, in that it raises the weight of the glazing and this may compel the use of a reinforced window, and moreover, the increase in cost is not negligible. Another widespread means comprises replacing the monolithic glasses by laminated glasses. Here, the efficacy is limited and the rise in cost is even greater than in the previous case.

A means which is difficult to use for glazings intended to equip windows but which is widespread in inside partitions or in railway vehicles comprises raising the thickness of the air space. However, the effect is noticeable only for air thicknesses of several centimeters (5 or 6), and this prevents production of such variants in sealed insulating glazings.

An efficacious means lies in the use of special laminations. Thus, the European Patent Application EP 100 701 B1 describes an insulating glazing including one or two laminated elements whose resin is "such as a bar 9 cm in length and 3 cm in width, consisting of a laminated glass comprising two glass sheets 4 mm in thickness, joined together by a 2 mm layer of this resin, has a critical frequency which differs at most by 35% from that of a glass bar having the same length, the same width and 4 mm in thickness". The working principle of this type of glazing based on a low stiffness of the resin, independently of its damping, allows a very marked improvement in comparison with the ordinary laminated glazing but the price thereof is also noticeably higher.

Certain studies have proposed the use of panels of standard thickness and the installation at the periphery of the box of Helmholtz resonators tuned to the cavity of the box (see MASON and FAHY, Journal of Sound and Vibration, Vol. 124 (2), pages367 to 379, Academic Press Ltd 1988). Patent Application WO-A-85 02640 thus proposes a box with an improved acoustic insulation at certain frequencies. In one of its variants it includes localized spherical resonators situated outside the box and in communication with the internal volume via ducts of small cross-section. This system, since it is tuned to one frequency, acts especially within a region around this frequency, but, in regard to the other frequencies, either it acts little, or else it acts negatively. Moreover, the volume of the resonator must be a sizeable fraction of that of the cavity proper—of the order of 15%— which, for example, for a 1 $m^2$ glazing with a 12 mm thick air space necessitates the installation at the periphery of the glazing of several "cylinders" whose total capacity is close to 2 liters; this solution is not suited to the customary conditions for manufacturing insulating glazings nor generally to the acoustic insulation of boxes of comparable thickness.

A variant resonator is also known in which the resonator/inside of the box link is not made via pipes as in the general case of Helmoltz resonators, but via a continuous link. Patent application DE-A-34 01 996 thus proposes a glazing whose glasses have different thicknesses and are mechanically detached from one another. A cavity of very large cross-section has been made at the periphery of the glazing and this makes it possible, taking into account its volume and the characteristics of the continuous slot which links it to the inside of the glazing, to tune the resonator in order to improve the insulation at a given frequency.

A variant of the glazings is also known which includes an absorbent peripheral material in which the latter is contained in a tube situated inside the glazing, at its periphery. Patent Application DE-A-27 48 223 proposes that the link between the inside and the outside of the tube containing the absorbent material be made via a very long narrow channel which extends from one end of the tube to the other. The working principle of this type of glazing is to cause the damping of sounds by an appropriate absorbent material. No variant without absorbent material is envisaged in DE-A-27 48 223.

SUMMARY OF THE INVENTION

Accordingly, one object of the present invention is to provide a novel insulating glazing which overcomes the drawbacks in the prior art devices.

More particularly, the problem which the present invention aims to solve is that of providing an insulating glazing made from usual monolithic glasses but with an improved performance, without overly increasing the manufacturing cost and weight.

The present invention also aims, more generally, to provide a simple and cheap solution to the problem of the acoustic insulation of multiple or double-walled sealed boxes filled with gas and/or air.

None of the technical solutions mentioned earlier n the case of glazings uses sealed insulating glazings made from usual monolithic glasses since they propose to act on their thicknesses or on their nature (normal or special laminations).

In order to improve the acoustic performance of a box, the present invention uses neither the principle of Helmoltz resonators situated outside the box nor that of the absorption of sounds by a suitable material situated between the panels, at the periphery of the internal gap.

The present invention proposes a box including at least one flat cavity comprising two substantially parallel panels assembled at their periphery with the aid of an insert frame, the cavity being filled with gas and/or air, and including a waveguide in communication with the cavity via one or more localized orifices, their shape, cross-section and position, as well as the cross-section of the waveguide, are determined so as to detune the acoustic and mechanical waves which arise in the cavity and on the panels respectively when the box is subjected to an incident acoustic field.

The detuning between acoustic and mechanical waves is evaluated by computing coefficients of energy coupling between the acoustic and mechanical modes and it is these coefficients which are minimized.

Preferably, the waveguide is placed at the periphery of the cavity and it is closed up on itself. Advantageously, the box is polygonal.

In the case where it is an insulating glazing with glass sheets as panels, the waveguide is integrated with the insert frame of the insulating glazing. The preferred embodiment of the present invention includes a waveguide and an insert frame which comprises a single tubular section comprising two compartments in communication via a narrow slot throughout their length, the outside compartment containing a desiccant.

Preferably, the extruded section constituting the waveguide and the insert frame is obtained by forming a thin aluminum plate.

A preferred manner of embodying the present invention makes a provision that the orifices for communication between the waveguide and the cavity each constitute a unit whose width is at least locally, near the width of the waveguide and whose length is between 2% and 25% of the length of the relevant side and preferably between 2% and 5%. When the glazing is rectangular, the orifices are preferably situated in the middle of the sides and they comprise a series of equidistant circles.

In the technique of the present invention such that it is in its most elaborate variant, a rectangular insulating glazing with a peripheral waveguide is linked to the cavity by localized openings along the guide, thereby making it possible to substantially improve the acoustic performance of a traditional glazing with easily implementable and inexpensive means.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
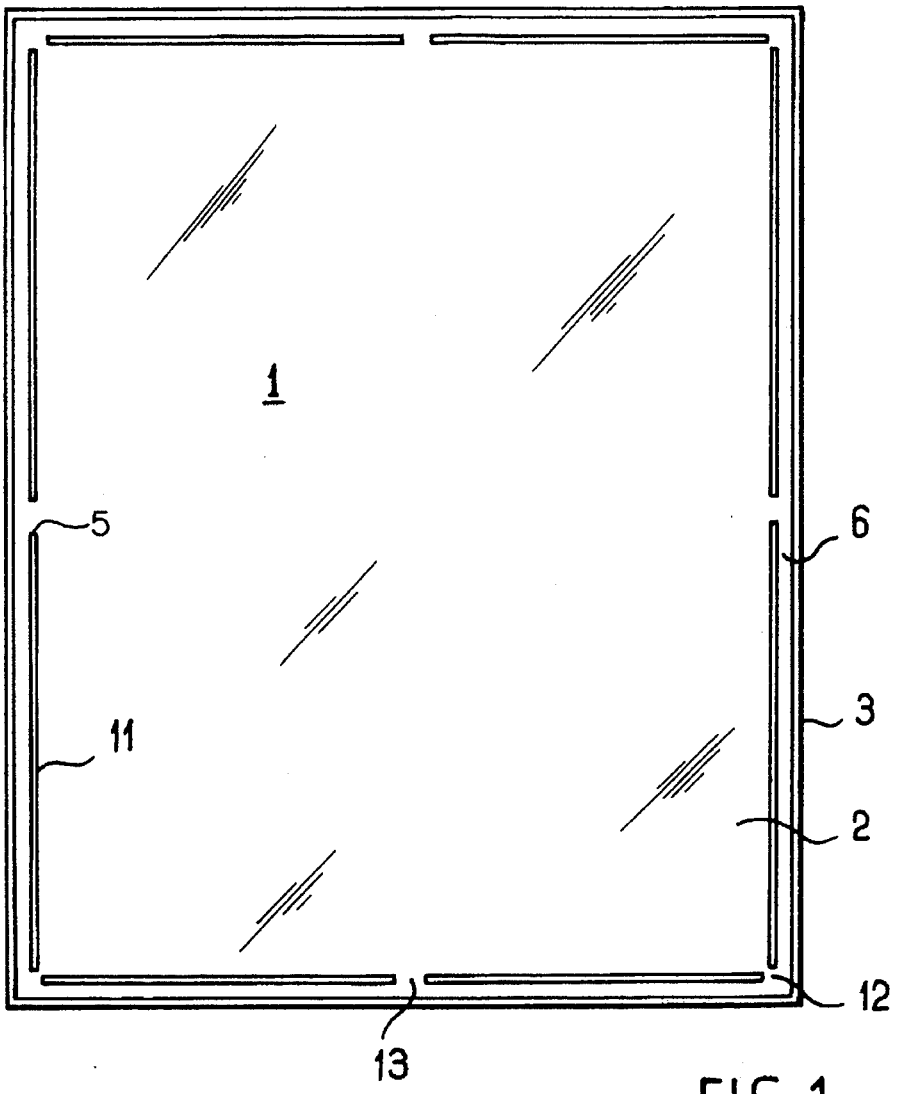
FIG. 1 shows an embodiment of a box according to the present invention.

The principle of the present invention is as follows: in order to increase the acoustic insulation of a box made from two parallel panels separated by a small gap and linked at their periphery by a frame, thus producing a cavity, it is proposed to produce on the periphery of the box a waveguide of cross-section (A) which communicates with the air or gas space trapped between the two walls, by way of openings of cross-section (s) which are placed at appropriate sites. The main purpose of this waveguide is to detune the acoustic and mechanical waves which arise respectively in the air or gas space and on the walls when the double-walled box system is subjected to an incident acoustic field.

In order to determine the optimal geometric characteristics (A,s, and the position of the openings), use is made of a computing method which comprises discretising the air or gas space and the walls by acoustic and mechanical finite elements. The acoustic finite elements make it possible to very accurately compute the modification in the internal acoustic modes of the air space through the adjoining of the waveguide, while the mechanical finite elements make it possible to equally accurately compute the eigenmodes of the two walls.

In order to take into account the vibro-acoustic coupling between the walls and the gas or air space, a mixed formulation is used, developed by Professor HAMDI's team at the Université de Technologie de Compiègne, see "Methods of Discretization By Finite Elements And Boundary Finite Elements" by HAMDI in THE ACOUSTIC RADIATION OF STRUCTURES, published by Eyrolles, Paris 1988. This formulation rests upon the application of Hamilton's principle to the coupled fluid/structure system, described in terms of the acoustic and mechanical modal components which constitute the unknowns of the problem. The main advantage of this formulation is of explicitly bringing out the energy coefficients for the coupling between the internal acoustic modes and the mechanical modes of the walls.

The principle of the method therefore comprises searching for the characteristic dimensions of the waveguide in such a way as to minimize the energy coupling coefficients.

In order to compute the reduction index of the double-walled system fitted with the waveguide, subsequent use is made of a boundary finite element method, likewise developed by Professor HAMDI's research team, which makes it possible to compute the radiation impedance of the walls and the reduction index of the double-walled system subjected to an acoustic field of incident plane waves.

The method is as follows: starting from a given basic structure, for example an insulating glazing comprising two glass panels 4 mm thick separated by an air space of 12 mm, a waveguide compatible with the characteristics of the structure is imagined. In the case of a glazing for example, it will in general be preferred to place it at the periphery. The computation dictates the elements A, s and the position of the openings which, a priori, will give the best results while remaining compatible with the final product. Thus, for an insulating glazing, the peripheral waveguide will be prevented from encroaching too deeply into the field of view of the glazing. Similarly, still in the case of a glazing, the openings will be placed at symmetrical locations, preferably in the middle of each of the sides.

The computing software developed comprises ultimately in executing the following 6 steps:

1. Finite element meshing of the gas or air space and of the walls;

2. Computation of the vibrational modes of the walls;

3. Computation of the acoustic modes of the gas or air space in the absence and in the presence of the waveguide;

4. Computation of the coefficients of the energy coupling between the acoustic and mechanical modes. It is at this stage that it is possible to see whether decoupling occurs and over which frequencies. The goal is indeed to cause a break in impedance between panels and waveguide.

5. Computation of the acoustic radiation impedance matrices for the walls; and

6. Computation of the reduction index for the double-walled system.

The result of this modelling of the box manifested by the curve for the acoustic reduction index as a function of frequency makes it possible to judge the effect provided by the chosen waveguide. The computation makes it possible iteratively to modify one, two or three of the parameters A, s and position of the openings which define the guide in such a way as to improve the reduction index, and experimentation then makes it possible to check the validity of the acoustic result of the novel box waveguide unit.

EXAMPLE 1

The preceding method has been applied to a 4(12)4 double glazing made from two 4 mm thick float glass panels separated by a 12 mm air space and assembled with an aluminum frame filled with a desiccant (molecular sieve) and cemented with butyl and polysulphide. The dimensions of the glazing were 1.23×1.48 $m^2$.

Figure 2:
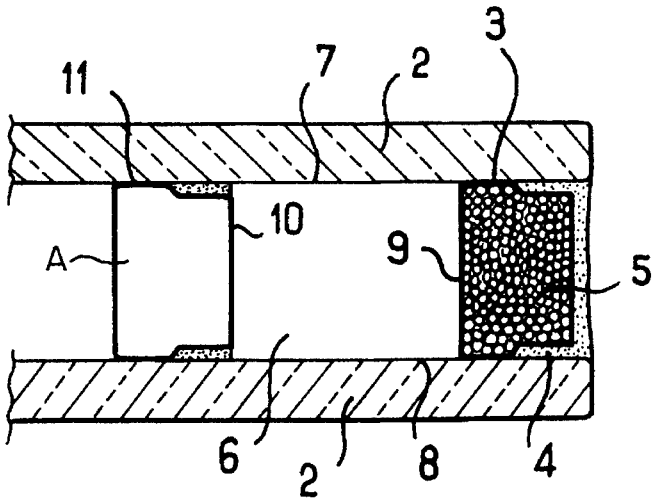
FIG. 2 exhibits a detail of the box of FIG. 1.

The various steps of the method described above applied to the glazing ended by culminating, following successive approximations, in a product represented in FIGS. 1 and 2.

This involved producing, at the periphery of the glazing, a waveguide of 240 $mm^2$ cross-section communicating via eight linking orifices with the cavity, including four, 54 $mm^2$ in cross-section at the four angles of the glazing and four, 480 $mm^2$ in cross-section at the middles of its sides.

The glazing 1 with its glasses 2 and its peripheral tubular section 3 is seen in FIG. 1.

The cement 4 and the desiccant 5 are represented in FIG. 2. All these elements are traditional. The waveguide is represented at 6 in FIGS. 1 and 2. It is constructed with four walls: the internal surfaces 7 and 8 of the glasses, the internal wall 9 of the insert frame and, for the fourth wall, the external face 10 of an tubular section 11 identical to the tubular section of the frame has been used. This tubular section 11 is cemented between the two glasses like the tubular section of the frame. It is cut up into stretches of a length such that they leave between them the linking orifices defined above, that is to say with an area of 54 $mm^2$ for the orifice 12 at the angles and of 480 $mm^2$ for those 13 at the middle of each of the sides. The tubular sections are void but their ends are plugged.

The experimental acoustic measurements carried out on the prototype just described have demonstrated a substantial improvement in performance by comparison with an identical glazing with the exception of the absence of tubular section 11. The results according to French Standard NF-S 31 051 were better by 3 dB(A) for road noise and according to ISO standard 717 ($r_w$) likewise by +3 dB.

EXAMPLE 2

The glazing of the second example was produced under industrial bulk production conditions.

Figure 4:
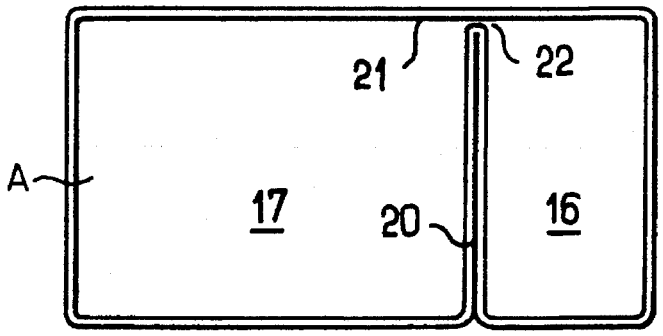
FIG. 4 shows the cross-section of the tubular section constituting the frame of the glazing of FIG. 3.

A tubular section intended to constitute the insert of an insulating glazing was produced by forming aluminum strip. This tubular section has a dual function, on the one hand it must fulfill the customary function of an insulating glazing frame and, on the other hand, it also incorporates the waveguide of the invention. The cross-section of the tubular section is represented in FIG. 4. The compartment reserved for the desiccant and for the fixing of the angles at the four corners of the glazing is seen at 16. The waveguide has been constituted at 17. A cross-section of 150 $mm^2$ has been chosen here. The prototype of the glazing was produced with 4 mm glasses in the same dimensions as before: 1.23×1.48 $m^2$.

Figure 3:
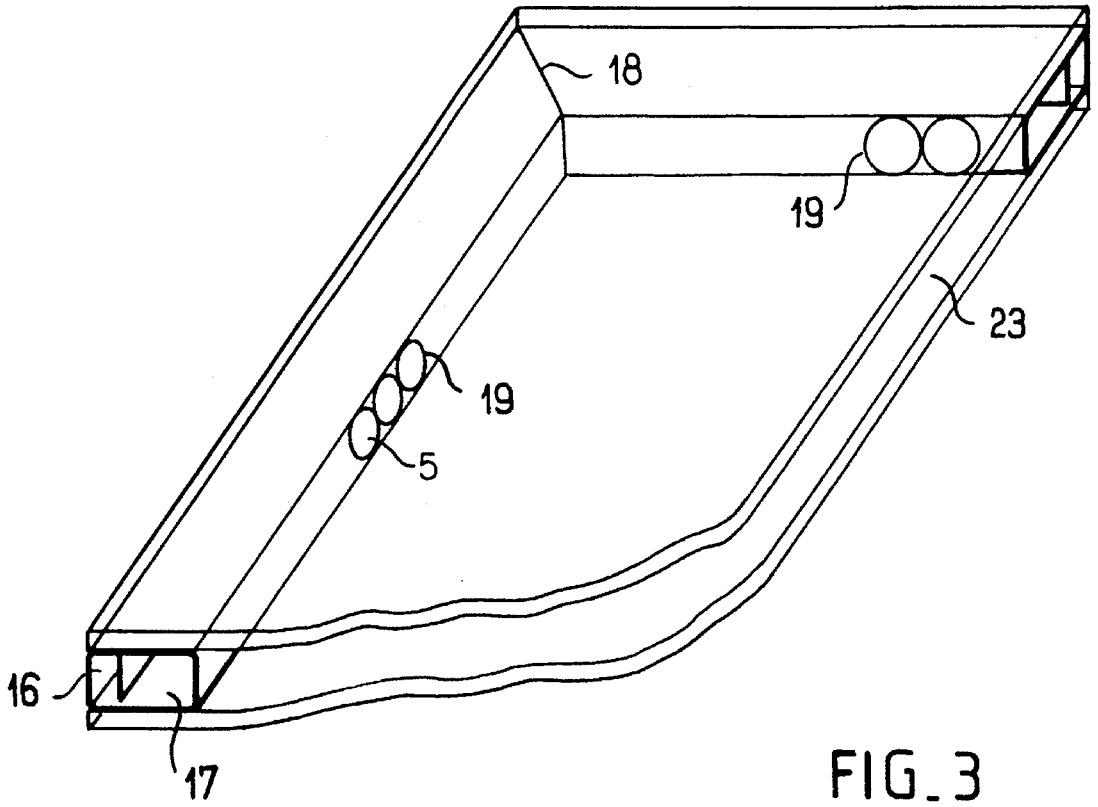
FIG. 3 represents a glazing according to the present invention.

By applying the method of the present invention, the energy coefficients for the coupling between the acoustic and mechanical modes was computed, and then, by computation, the manner in which the choice of the position, shape and cross-section of the openings in the tubular section succeed in minimizing these coefficients was examined. The position picked for the openings was the middle of each of the four sides of the glazing, the angles being assembled bevelled at 18, FIG. 3, without being leaktight. The shape of the orifices has been set as a series of almost mutually tangential circles 19. It is important for their diameter to be similar to the thickness of the tubular section. Another criterion of importance is the total length occupied by the collection of circles 19 in the middles of the sides of the glazing. This length must be at least 2% and at most 25% of the length of the side. Optimization provided a figure of 4 for the number of juxtaposed circular openings, both for the side of length 1.23 m and for that of 1.48 m.

The tubular section represented in FIG. 4 possesses an interesting feature: it was designed with an orifice for communication between the two chambers. The separating wall 20 does not come into contact with the perpendicular wall 21 but leaves a free gap 22 of, for example, 0.2 mm. This passage enables the desiccant (not represented) filling the compartment 16 to act by way of the compartment 17 and of the openings 19 on the internal gap 23 of the insulating glazing which it keeps permanently dry.

Full scale acoustic measurements were made on the glazing just described and, for comparison, on a glazing of the same dimensions but which was not equipped with the waveguide of the present invention.

The trials were carried out according to ISO Standard 140 in two reverberation chambers of respective volumes 62 and 86 $m^3$.

Figure 5:
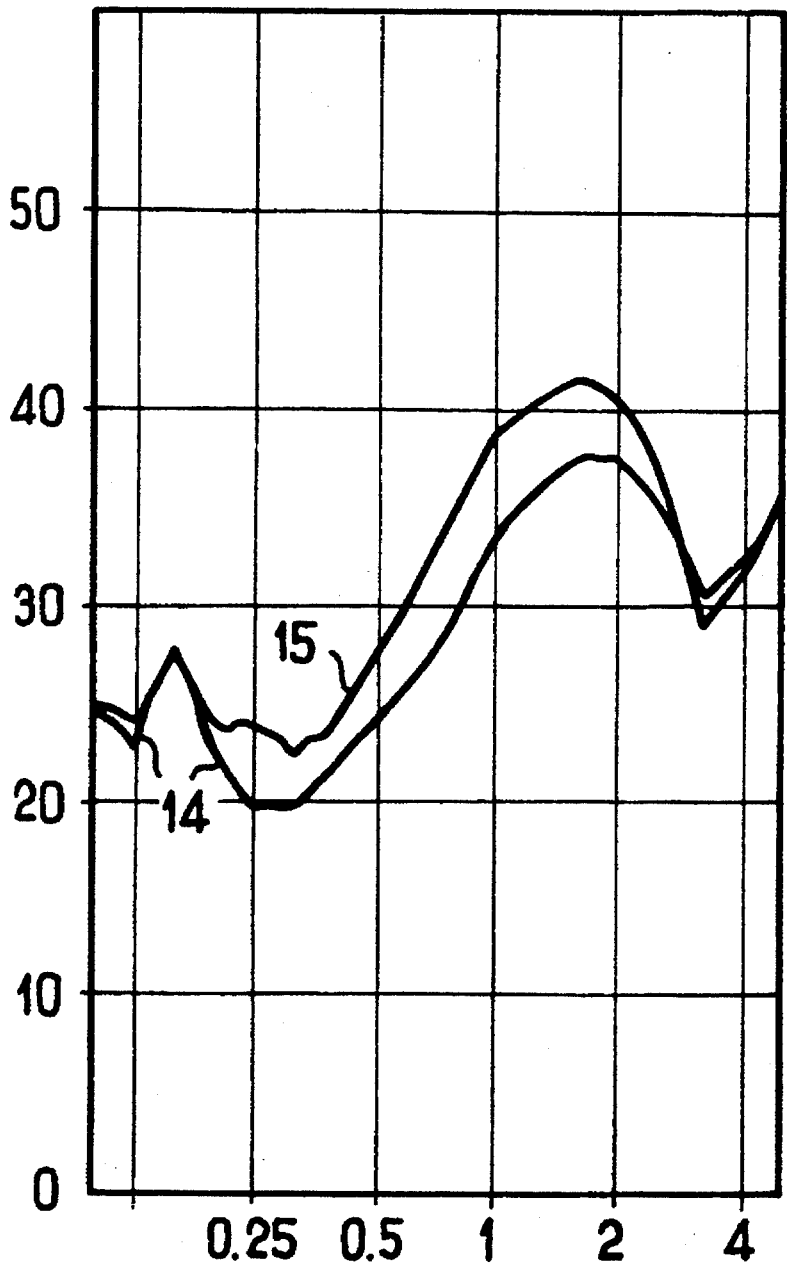
FIG. 5 shows the acoustic results of a glazing according to the present invention by comparison with the same glazing not equipped with the device of the present invention.

The results are represented in FIG. 5. The frequencies (in kHz) are seen as abscissae and the acoustic reduction indices are seen as ordinates. The curve 14 represents the results of the traditional 4(12)4 insulating glazing filled with air, while the curve 15 shows those of a glazing of the same dimensions, still 4(12)4, but with the peripheral waveguide of FIGS. 3 and 4 of the present invention. It is observed that, between 200 Hz and 2500 Hz, the glazing of the present invention is superior by a value of between 2 and 5 dB to an ordinary glazing. The general form of the curve shows that the effect does not show up at a localized frequency as is the case with Helmholtz resonators, but over a wide band of the audible spectrum.

From the preceding curves, the overall values of the acoustic reduction index were computed, on the one hand according to French Standard NF-S 31 051 (reduction index for road noise $R_{rd}$ and for pink noise $R_{pink}$, respectively) and according to ISO Standard 717 ($R_w$).

The results were as follows:

| | 4(12)4 | 4(12)4 + waveguide |
|---|---|---|
| $R_{rd}$ | 26.3 | 29.6 |
| $R_{pink}$ | 29.5 | 32.1 |
| $R_w$ | 30 | 33 |

The waveguide produces its effect perfectly by disturbing the coupling which the air space customarily produces between the first and the second plane. The role of the guide is to enable the sound wave to circulate, and this is why it is important for the number of orifices for communication between the cavity and the guide not to be too large, which would hamper this free circulation.

Embodiments 1 and 2 of the boxes of the present invention use transparent glass panels but, quite obviously, the acoustic results do not depend on the nature of this material. Panels of plate metal or of any other material with a modulus of elasticity of the same order would lead to comparable results.

It emerges from the foregoing that the present invention proposes an innovative solution very unlike not only systems which act on the panels proper (thicknesses, laminated units, special resins) but even those which act on the cavity (Helmholtz resonators or peripheral absorbers). In relation to these other treatments it has the advantage of being inexpensive, easy to implement in industry and aesthetically discreet.

Obviously, numerous modifications and variations of the present invention are possible in light of the above teachings. It is therefore to be understood that within the scope of the appended claims, the present invention may be practiced otherwise than as specifically described herein.

What is claim as new and desired to be secured by letters patent of the united states is:

1. A box comprising:

at least one flat cavity comprising two substantially parallel panels connected at their periphery by an insert frame;

a gas filling the cavity;

a waveguide means in communication with the cavity via one or more localized orifices formed only at predetermined locations along said waveguide to occupy only a portion of said waveguide, the shape, cross-section and position of the one or more localized orifices, as well as the cross-section of the waveguide, are determined for detuning acoustic and mechanical waves which arise in the cavity and on the panels respectively when the box is subjected to an incident acoustic field;

wherein the box is an insulating glazing whose panels are glass sheets and the waveguide is integrated with the insert frame of the insulating glazing; and wherein the waveguide and the insert frame comprise a single tubular section comprising an inside compartment and outside compartment formed outside of the inside compartment which are in communication one with the other and in that the outside compartment contains a desiccant.

2. The box according to claim 1, wherein the detuning between acoustic and mechanical waves is evaluated by computing coefficients of energy coupling between the acoustic and mechanical modes and in that it is these coefficients which are minimized.

3. The box according to claim 1, wherein the waveguide is placed at the periphery of the cavity.

4. The box according to claim 3, wherein the waveguide is a closed loop.

5. The box according to claim 3, wherein the box is polygonal.

6. The box according to claim 1, wherein the two compartments are in communication via a narrow slot.

7. The box according to claim 1, wherein the single tubular section constituting the waveguide and the insert frame is obtained by bending a thin aluminum plate.

8. A box comprising;

at least one flat cavity comprising two substantially parallel panels connected at their periphery by an insert frame;

gas filling the cavity:

a waveguide means in communication with the cavity via one or more localized orifices formed only at predetermined locations along said waveguide to occupy only a portion of said waveguide, the shade, cross-section and position of the one or more localized orifices, as well a the cross-section of the waveguide, are determined for detuning acoustic and mechanical wave which arise in the cavity and on the panels respectively when the box is subjected to an incident acoustic field;

wherein the box is an insulating glazing whose panels are glass sheets and the waveguide is integrated with the insert frame of the insulating glazing; and further comprising localized orifices for communication between the waveguide and the cavity, wherein the localized orifices each constitute a unit whose length is between 2% and 25% of the length of the side of the box on which the localized orifices are formed.

9. The box according to any one of claims 5, 6 or 8 further comprising localized orifices for communication between the waveguide and the cavity, wherein the localized orifices each constitute a unit whose length is between 2% and 5% of the length of the side of the box on which the localized orifices are formed.

10. A box comprising:

at least one flat cavity comprising two substantially parallel panels connected at their periphery by an insert frame;

a gas filling the cavity;

a waveguide means placed at a periphery of the cavity in communication with the cavity via one or more localized orifices formed only at predetermined location along said waveguide to occupy only a portion of said waveguide, the shape, cross-section and position of the one or more localized orifices,as well as the cross-section of the waves guide are determined for detuning acoustic and mechanical waves which arise in the cavity and on the panels respectively when the box is subject to an incident acoustic field;

wherein the waveguide is closed up on itself and the box is polygonal; and further comprising localized orifices for communication between the waveguide and the cavity, wherein the localized orifices each constitute a unit whose length is between 2% and 25% of the length of the side of the box on which the localized orifices are formed.

11. The box according to claim 10, wherein a width of the orifices is, at least locally, near a width of the waveguide.

12. The box according to claim 10, wherein the glazing is rectangular, the orifices are situated in a middle of sides of the glazing and the orifices comprise a series of equidistant circles.

13. The box according to claim 11, wherein the glazing is rectangular, the orifices are situated in a middle of sides of the glazing and the orifices comprise a series of equidistant circles.

* * * * *